US005195919A

United States Patent [19]

Hasegawa

[11] Patent Number: 5,195,919

[45] Date of Patent: Mar. 23, 1993

[54] PANEL PIECE COMBINATION TOY

[75] Inventor: Bungo Hasegawa, Machida, Japan

[73] Assignee: Ozen Corporation, Machida, Japan

[21] Appl. No.: 807,124

[22] Filed: Dec. 11, 1991

[30] Foreign Application Priority Data

May 29, 1991 [JP] Japan ..... 3-126005

[51] Int. Cl.[5] ..... A63H 5/00

[52] U.S. Cl. ..... 446/397; 446/302; 446/409; 434/259; 369/63

[58] Field of Search ..... 446/397, 409, 405, 302, 446/297, 299, 408, 303; 434/259, 303; 273/157 R, 156; 369/63, 65, 66, 67

[56] References Cited

U.S. PATENT DOCUMENTS 3,286,396 11/1966 Ryan ..... 446/397 X
4,348,191 9/1982 Lipsitz et al. ..... 446/297 X
4,820,233 4/1989 Weiner ..... 446/303

FOREIGN PATENT DOCUMENTS 0291735 4/1988 European Pat. Off. .
3-31345 7/1991 Japan .

*Primary Examiner*—Mickey Yu
*Attorney, Agent, or Firm*—Weintraub, DuRoss & Brady

[57] ABSTRACT

A panel piece combination toy includes a panel piece having a predetermined shape and a base plate having a fitting hole into which the piece panel is fitted. The panel piece has a sound generating device built in the panel piece.

4 Claims, 5 Drawing Sheets

PANEL PIECE COMBINATION TOY

BACKGROUND OF THE INVENTION

1. Field of the Invention

The present invention relates to a combination toy for combining panel pieces themselves, or combining a panel piece with a base plate, such as a jigsaw puzzle or a fitting toy, and in particular, to such a toy in which an interest is increased and an intellectual training effect progresses.

2. Description of the Prior Art

As prior art combination toys, a jigsaw puzzles are known, in which a sheet of thick paper having a picture or pattern drawn thereon is divided into a plurality of panel pieces respectively having special shapes, and the plurality of divided panel pieces are combined to complete the picture or pattern, and fitting toy is also known in which a panel piece having a special shape is fitted into a base plate formed with a recess having a shape corresponding to the shape of the panel piece.

In the prior art combination toys as mentioned above, for example, in the case of the jigsaw puzzle, a main factor which excites an interest is a process to complete a picture or a pattern by combining panel pieces, and an appreciation of the completed picture or pattern. Also, in the case of the fitting type toy, an interest is excited by making up a shape corresponding to a specific idea such as an animal or a vehicle by fitting individual panel pieces into recesses, or a process of fitting panels into specific positions of a base plate constributes to the effect of intellectual training.

It cannot be denied that even with the prior art combination toys, a certain degree of interest is excited, and an intellectual tranining effect can be expected corresponding to the interest. However, a sufficient effect is not attained, and a need always exists for new and improved children's toys.

SUMMARY OF THE INVENTION

The present invention was made in view of the above-mentioned problems, and it is an object of the invention to provide a panel piece combination toy which excites an interest to a great extent and which contributes to a significant intellectual training effect.

In order to achieve the above-mentioned object, in a first aspect of the invention, in a piece panel combination toy in which a panel piece is combined with the other member, the panel piece has a sound generating means built therein.

In a second aspect of the invention, the sound generating means includes a disk record disposed in a casing, a driving mechanism for rotating the disk record, a pickup for scanning a modulated groove in an upper surface of the disk record, and a diaphragm formed by making at least a part of a side of the casing with a thin thickness, wherein the pickup abuts against the diaphragm.

In a third aspect of the invention, the sound generating means includes a disk record disposed in a casing, a driving mechanism for rotating the disk record, a pickup for scanning a modulated groove in an upper surface of the disc record, and a stylus force mechanism for applying a stylus force to the pickup and releasing the stylus force applied to the pickup. The stylus force mechanism includes an elastic member for urging the disk record towards the casing from a lower side of the disk record, and an expansion and constriction mechanism disposed between an upper surface of the disk record and the casing. The expansion and constriction mechanism includes a disk record side member fixed to the disk record, and a casing side member which abuts against the casing and is connected to the driving mechanism. Each of the members is formed at one surface with at least one operating claw having an engaging side rising perpendicularly and a slant side having a gradual inclination, and the members are disposed one on the other so that the engaging sides and the slant sides of both the members are in abutment with each other.

In a fourth aspect of the invention, the panel piece has a shape representing a specific idea, and the sound generating means generates a kind of sound corresponding to the specific idea.

In the first aspect of the invention, by generating the sound by the sound generating means, a feeling of unexpectedness is produced because the sound is generating from the panel piece.

In the second aspect of the invention, the diaphragm is formed by making a thickness of a part of the casing thin, and the pickup is made to abut against the diaphragm so as to generate the sound by vibrations of the diaphragm. As a result, there is no need to provide a speaker separately, and the thickness of the sound generating means becomes a thin type.

In the third aspect of the invention, when the casing side member is rotated in a predetermined direction by the driving mechanism, the operating claw of the casing side member is brought into abutment with the operating claw of the disk record side member with respective engaging sides of both the members abutting against each other. As result, a rotational force of the casing side member is transmitted to the disk record side member to rotate the disk record, and at the same time, since the elastic member urges the disk record towards the casing from the lower side of the disk record, a stylus force is applied to the pickup and sound reproduction is performed.

On the other hand, when the casing side member is rotated in the opposite direction, both the operating claws are brought into abutment against each other with their slant sides, and one of the operating claws rides over the other. As a result, an interval between both the members is increased to expand the expansion and constriction mechanism, and the disk record is displaced downwardly against an urging force of the elastic member thereby to release the stylus force of the pickup.

Thus, in the third aspect of the invention, since the stylus force mechanism is composed of the elastic member and both members being operating claws respectively, the structure is simple and the sound generation means becomes thin.

Furthermore, in the fourth aspect of the invention, since the shape of the panel piece and the kind of sound generated by the sound generating means are corresponding to a specific idea, for example, an animal, a vehicle, or the like, an intellectual training effect is obtained through the recognition of a relationship between the shape of the panel piece and the kind of sound generated from this panel piece.

DESCRIPTION OF THE PREFERRED EMBODIMENTS

The embodiments of the present invention will be described with reference to the drawings.

FIGS. 1 to 8 are drawings illustrating a first embodiment of the invention in which the present invention is applied to a fitting type toy, and in this fitting type toy, a panel having a specific shape is fitted into a recess matched with the panel shape and formed in a base plate.

Figure 1:
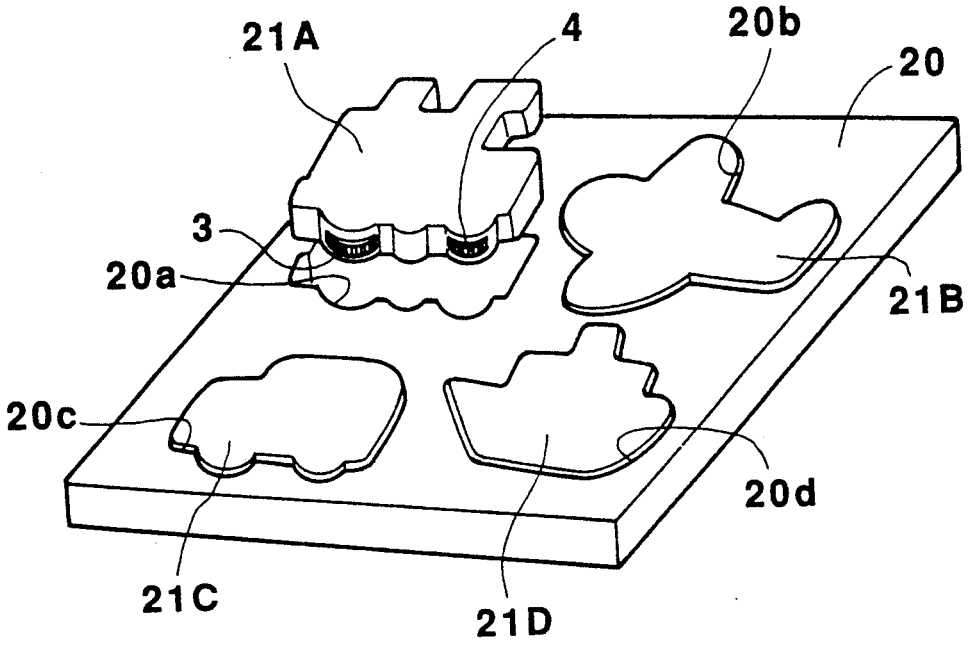
FIG. 1 is a perspective view showing an overall arrangement of a first embodiment of the present invention.

In an arrangement, as shown in FIG. 1, a base plate 20 is formed with fitting holes 20*a* to 20*d* which penetrate through a back surface and which are matched with panel pieces 21A to 21D respectively having specific shapes so that the panel pieces 21A to 21D can be fitted into the fitting holes 20*a* to 20*d*, and can also be removed therefrom.

Each of the panel pieces 21A and 21D has a shape representing a specific idea, and in this embodiment, the panel piece 21A has a shape of a locomotive, the panel piece 21B has a shape of an aeroplane, the panel piece 21C has a shape of an automobile, and the panel piece 21D has a shape of a ship.

FIGS. 2 to 8 show a structure of the panel piece 21A. Structures of the other panel pieces 21B to 21D are substantially the same as the structure of the panel piece 21A with the exception of the outer appearances, and thus description of these panel pieces is omitted.

Figure 2:
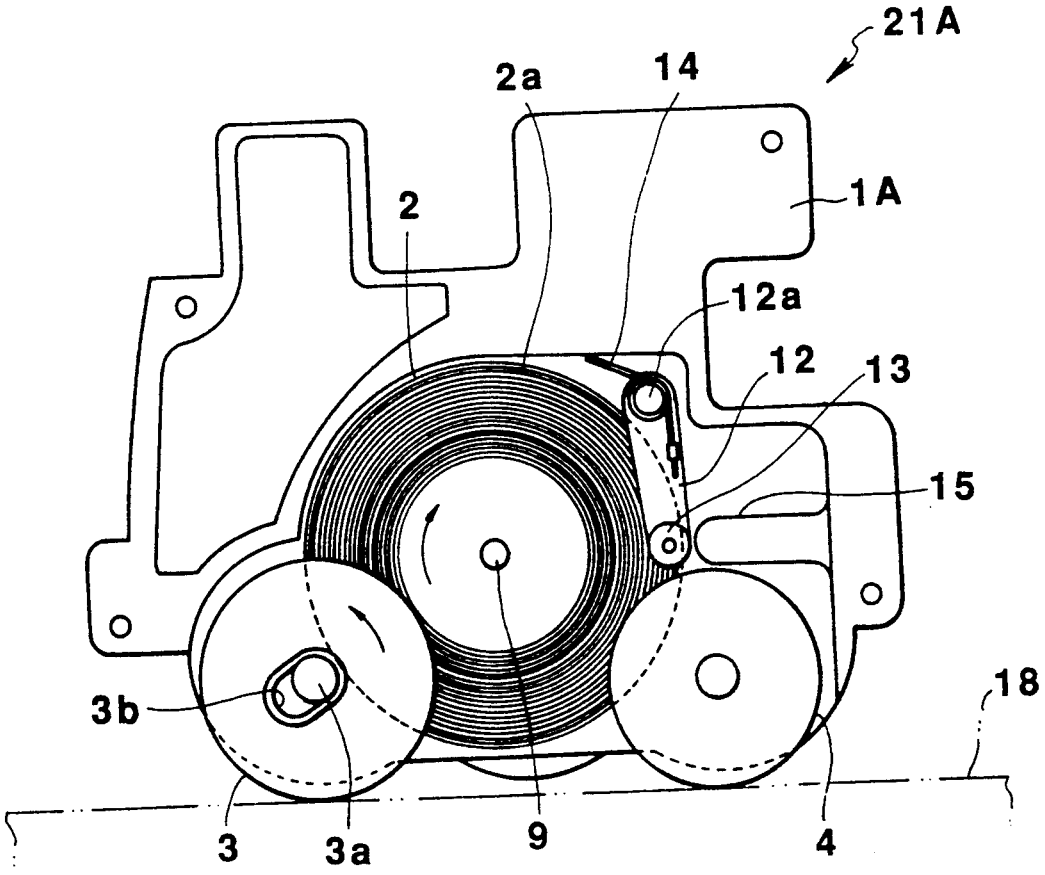
FIG. 2 is a plan view showing a part of an internal structure of a panel piece.
Figure 3:
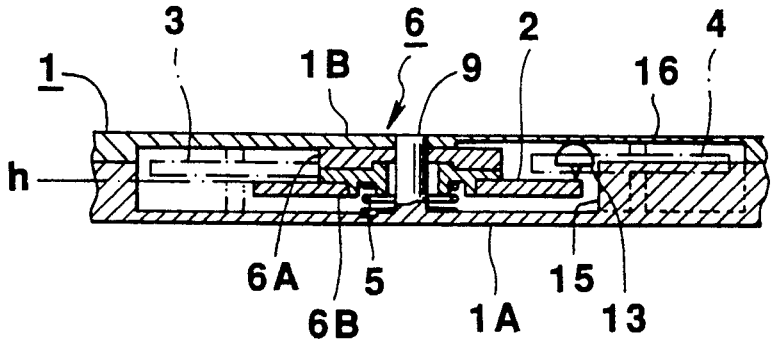
FIG. 3 is a side sectional view showing an internal structure of a panel piece.

Specifically, FIG. 2 is a plan view of a part of an internal structure of the panel piece 21A, and FIG. 3 is a side sectional view of the internal structure of the panel piece 21A, and as shown in these figures, the panel piece 21A having an outer appearance of the locomotive shape has a casing 1 composed of a main body 1A located at a lower side and a cover 1B located at an upper side, so that the panel piece 21A is formed in a flat box shape having wide upper and bottom surfaces and having a thin thickness.

In the inside of the casing 1, there are provided a disk record 2 and a driving mechanism including a frictional driving wheel 3 and an auxiliary wheel 4. The frictional driving wheel 3 and the auxiliary wheel 4 are supported between the main body 1A and the cover 1B rotatably and in parallel with each other.

Furthermore, a stylus force spring 5 is disposed between a lower surface of the disk record 2 and the main body 1A of the casing 1, and the stylus force spring 5 serves as an elastic member for urging the disk record 2 towards the cover 1B of the casing 1. An expansion and constriction mechanism 6 is disposed between the upper surface of the disk record 2 and the cover 1B.

Figure 4:
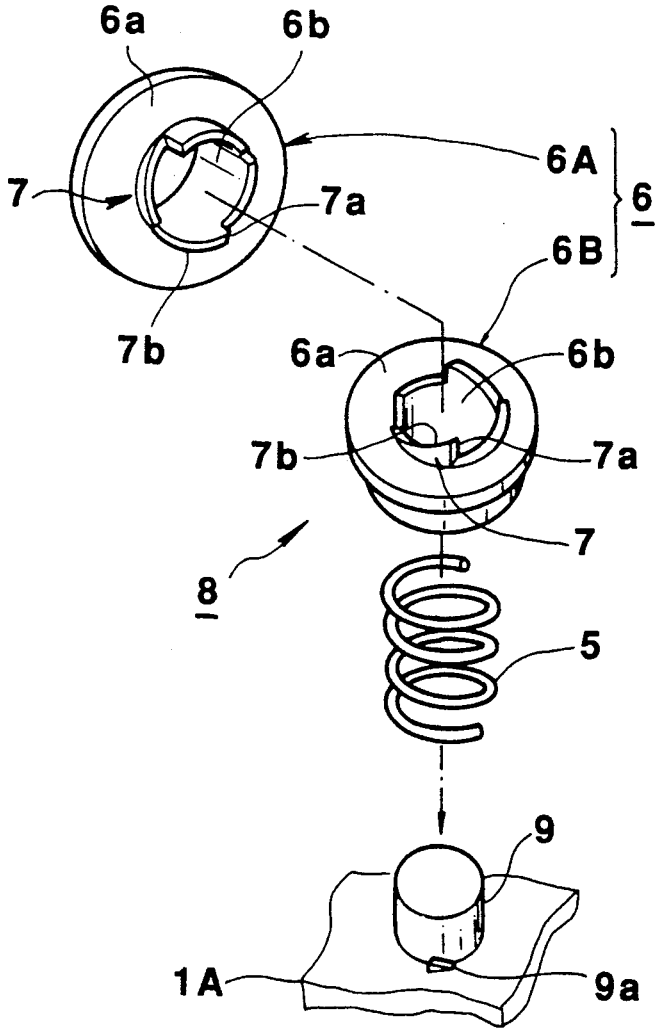
FIG. 4 is a perspective view of a disassembled expansion and constriction mechanism.

FIG. 4 is a perspective view of the disassembled expansion and constriction mechanism 6 which includes a casing side member 6A whose upper surface abuts against an inner surface of the cover 1B of the casing 1, and a disk record side member 6B fixed to the disk record 2. Both the members 6A and 6B have a shape in which disk-shaped main bodies 6*a* are respectively formed with center holes 6*b* at a center of the main bodies 6*a*.

A rotary shaft 9 formed on the main body 1A of the casing 1 is inserted through the center holes 6*a* and 6*b* of both the members 6A 6B, and an upper end of the stylus force spring 5 is fixed to a lower surface of the disk record side member 6B so that the stylus force spring 5 surrounds the rotary shaft 9. As a result, both the memebers 6A and 6B are concentrically and rotatably supported.

Here, the stylus force spring 5 and the expansion and constriction mechanism 6 constitute a stylus force mechanism 8.

As shown in FIG. 3, in a assembled condition, the stylus force spring 5 urges the expansion and constriction mechanisms 6 towards the cover 1B of the casing 1, and pushes the disk record upwardly to a height h (hereinafter, referred to as a sound reproducing height h) at which the pickup 13 abuts against the disk record 2. Furthermore, since a wedge-shaped projection is formed at a predetermined position on an outer peripheral surface of the rotary shaft 9, the projection serves as a stopper 9*a* when the stylus force spring 5 is rotated in a reverse direction.

Each of the members 6A and 6B has four operating claws 7 on a surface confronting the counterpart member along a circumferential edge of the center hole 6*a*. Each of the operating claws 7 is of a saw-toothed shaped having an engaging side 7*a* rising in parallel with the rotary shaft 9 and a slant side 7*b* having a gradual inclination. When both the members 6A and 6B are stacked one on the other, the operating claws 7 and 7 of both the members 6A and 6B are engaged with each other in which both the slant sides 7*b* and 7*b* abut against each other. Hereinafter, the rotation in a forward direction represents a direction of rotation in which a force is exerted between both the engaging sides 7*a* and 7*a*, and the rotation in a backward direction represents a direction of rotation in which a force is exerted between both the slant sides 7*b* and 7*b*.

Returning to FIG. 2, a supporting hole 3*b* of the casing 1 for rotatably supporting a rotary shaft 3*a* of the frictional driving wheel 3 is a slot extended in a direction orthogonal to the rotary shaft 9, and as a result, the frictional driving wheel 3 is allowed to advance and retreat in the direction orthogonal to the rotary shaft 9. When the frictional driving wheel 3 is rotated at a position approaching the rotary shaft 9, a peripheral side surface of the frictional driving wheel 3 abuts against a peripheral side surface of the casing side member 6A, and a rotational force of the frictional driving wheel 3 is transmitted to the casing side member 6A.

Furthermore, a tone arm 12 is disposed above the disk record 2, and its base portion 12*a* is rotatably supported by the main body 1A of the casing 1, and at the same time, its tip end has a pickup 13 fixed thereto. Accordingly, the pickup 13 is rotatable about its base portion 12*a*.

A return spring 14 is attached to the tone arm 12 to urge the tone arm 12 towards a peripheral edge of the disk record 2. A stopper 15 for the tone arm 12 is formed on the main body 1A of the casing 1, and when the tone arm 12 has returned to an original position by the return spring 14, the pickup 13 is stopped at a sound reproduction stand-by position which confronts a sound reproduction starting end of a modulated groove 2*a* formed in an upper surface of the disk record 2.

Figure 5:
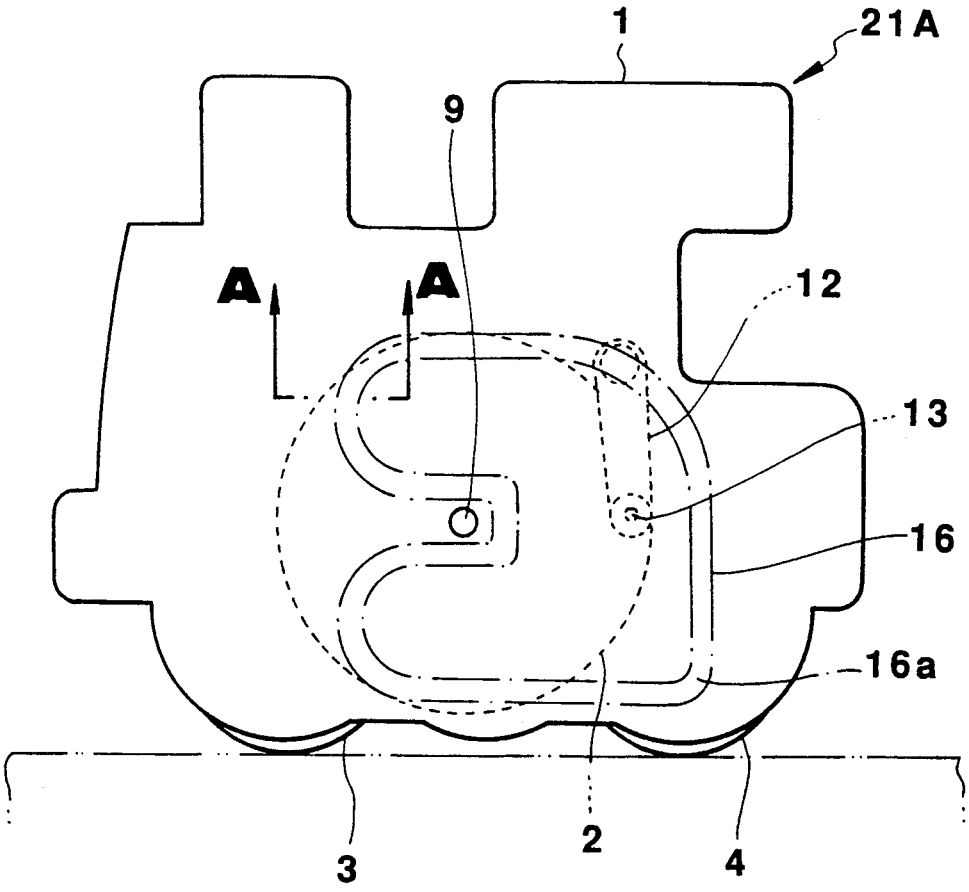
FIG. 5 is plan view of the panel piece.

FIG. 5 is a front view of the panel piece 21A, and as shown in FIGS. 3 and 5, a diaphragm or vibration plate 16 is formed by reducing a thickness of the cover 1B of the casing 1 so as to leave a peripheral portion of the rotary shaft 9 without reducing the thickness. The pickup 13 is made to abut against an inner surface of the diaphragm 16.

Figure 6:
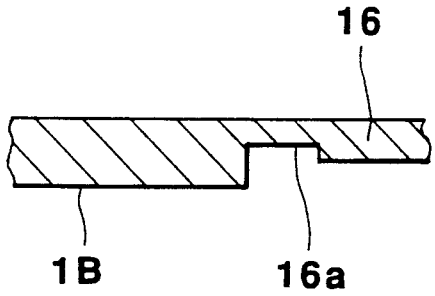
FIG. 6 is a sectional view taken along the line A—A in FIG. 5.

Specifically, as shown in FIG. 6, which is a sectional view taken along the line A—A in FIG. 5, the diaphragm 16 is formed by recessing and reducing the thickness of the inner surface of the cover 1B. Thus, an outer surface of the cover 1B remains as a flat surface.

A peripheral edge of the diaphagm 16 is further reduced in thickness to form a strip-like thin plate area 16*a* so that the diaphragm 16 has a structure which is further easily vibrated.

Next, the operation of the embodiment of FIGS. 1-8 will be described.

As shown in FIG. 1, each of the panel pieces 21A to 21D can be fitted into and removed from the base plate 20, however, each of the panel pieces 21A to 21D is allowed to be fitted only into the corresponding matched fitting hole 20*a* to 20*d*.

In other words, the fitting-into operation is carried out by recognizing the shapes of the panel pieces 21A and 21D and the shapes of fitting holes 20*a* to 20*d*, and by determining a correspondence therebetween. Accordingly, the combination toy of this embodiment is suitable as an intellectual child training toy.

Furthermore, in this embodiment, each of the panel pieces 21A to 21D can generate a sound as described hereinafter.

Specifically, under a condition wherein the tone arm 12 is at the sound reproduction stand-by position, as shown in FIG. 2, when the panel piece 21A is moved to the side of the frictional driving wheel 3 with the frictional driving wheel 3 and the auxiliary wheel 4 pressed against a floor surface 18 or the like, since the frictional driving wheel 3 rotates with its peripheral side surface abutting against the peripheral side surface of the casing side member 6A of the expansion and constriction mechanism 6, the casing side member 6A is rotated in the forward direction.

Figure 7:
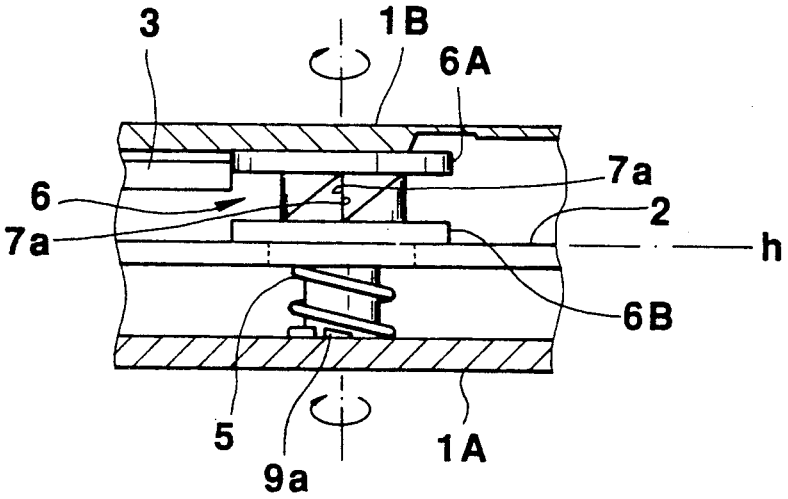
FIG. 7 is a sectional view useful to explain an operation of a stylus force mechanism when a stylus force is applied.

At this time, a shown in FIG. 7, as regards the state of the operating claws 7 and 7 of the casing side member 6A and the disk record side member 6B, since the engaging side 7*a* of the casing side member 6A pushes the engaging side 7*a* of the disk record side member 6A, a rotational force of the casing member 6A is transmitted to the disk record side member 6B, and the disk record 2 is rotated.

Further, since the disk record 2 is at the sound reproducing height h due to the urging force of the stylus force spring 5, the pickup 13 scans the modulated groove 2*a* because of the rotation of the disk record 2, and the vibrations of the pickup 13 are transmitted to the diaphragm 16 to reproduce the sound encoded on the disk record 2.

Figure 8:
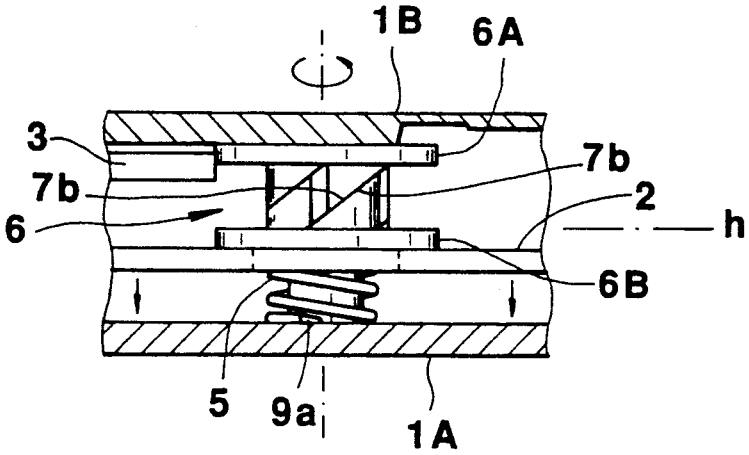
FIG. 8 is a sectional view useful to explain an operation of a stylus force mechanism when the stylus force is released.

With the progress of the sound reproduction of the disk record 2, when the pickup 13 reaches a terminating end of the modulated groove 2*a* and finishes the sound reproduction of the disk record 2, this time, as shown in FIG. 8, the panel piece 21a is moved to the side of the auxiliary wheel 4 so as to rotate the casing side member 6A in a reverse direction.

At this time, in the operating claws 7 and 7 of both the member 6A and 6*b*, since one of the slant sides 7*b* and 7*b* rides over the other of the slant sides 7*b* and 7*b*, an interval between both the members 6A and 6B is increased, and the disk side member 6B moves downwardly against the urging force of the stylus force spring 5 so that the disk record 2 moves to a position lower than the sound reproducing height h.

Under this condition, the stylus force of the pickup 13 is released so that the engagement between the pickup 13 and the modulated groove 2*a* of the disk record 2 is released, and the tone arm 12 returns to the sound reproduction stand-by position due to the urging force of the return spring 14. Further, at this time, since an end portion of the stylus force spring 5 is held by the stopper 9*a*, the disk record side member 6B is not rotated, and thus, the disk record 2 is never allowed to rotate in a reverse direction.

By repeating the above-mentioned operations, sound encoded on the disk record 2 is able to be reproduced continuously.

As described above, in a disk record sound reproducing device serving as sound generating means built in the panel piece 21A, since a part of the casing 1 constitutes the diaphragm 16, there is no need to provide a speaker separately, and further since the stylus force mechanism is constituted by the stylus force spring 5 and the expansion and constriction mechanism 6, the structure is simple and thin. As a result, the disk recored reproducing sound device described herein can be built in each of the panel pieces 21A to 21D without increasing the thickness of the panel pieces. In particular, in this embodiment, since the thin plate area 16*a* is formed, the vibrations of the diaphragm 16 are large, and reproduced sounds become clearly audible.

Furthermore, since the structure is simple, it is advantageous in that a large increase in costs can be avoided.

In this described embodiment, since unexpectedness in the generation of sound is provided, a large interest is excited as compared with the prior art fitting toy in which panel pieces are merely fitted into the base plate, and are incapable of producing sounds.

In addition, when the kinds of sounds generated from the disk record 2 are selected to correspond to the shapes of the panel pieces 21A to 21D, for example, a sound of a running locomotive, and sound of a flying aeroplane for the panel piece 21B having the shape of the aeroplane, a larger intellectual training effect will be obtained through the recognition of both the shape and the sound.

Further, when gear trains (not shown) are built in the base plate 20, and a part of the gear trains are formed as frictional wheels capable of transmitting a rotational force to the frictional driving wheels 3 of the panel pieces 21A to 21D, and when these gear trains have a structure able to be driven manually or by a motor, the disk records 2 built in the panel pieces 21A to 21D will be playable even when the panel pieces 21A to 21D have been fitted into the base plate 20. Thus, a further large interest will be excited.

Furthermore, when a picture book is formed with a plurality of base plates 20, vibrations will be offered and a further large interest will be excited.

Figure 9:
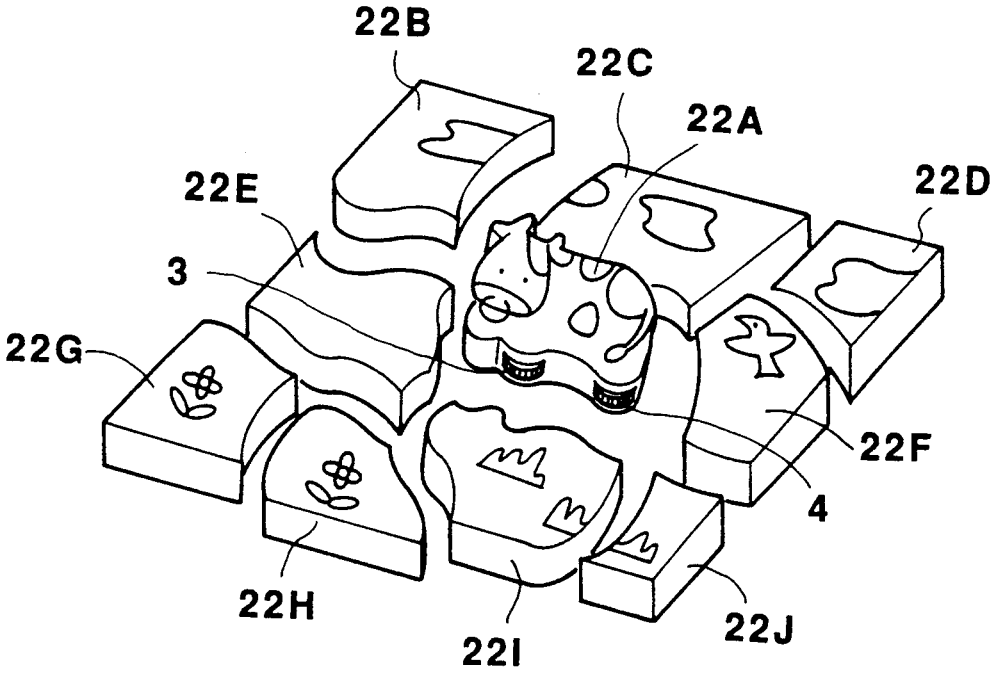
FIG. 9 is a perspective view showing an overall arrangement of a second embodiment of the present invention.

FIG. 9 shows a second embodiment of the present invention, in which the present invention is applied to a simple jigsaw puzzle.

Specifically, a thin plastic plate having a picture or a pattern drawn on a surface is divided into a plurality of panel pieces 22A to 22J, and a part of the panel pieces 22A to 22J, for example, the panel piece 22A located at a center is provided with a disk record sound reproducing device similar to that described in the first embodiment.

Also in this embodiment, different from a mere jigsaw puzzle, unexpectedness is provided in which the panel piece 22A generates a sound. Accordingly, similar to the first embodiment, an interest is increased and a significant intellectual training effect is expected.

In this case, when a kind of sound, for example, a cry of a cow is generated corresponding to the shape of the panel 22A, in this example, the cow, a larger intellectual training effect will be achieved, as is the case in the first embodiment.

While the manual type frictional driving wheel 3 is used as a driving device in each of the embodiments, when the driving device is formed by a sheet-like stepping motor, an electrical driving device will be obtained without increasing a thickness of the device.

Even in the case of the electrical driving device, by providing a necessary circuit in the base plate 20 or the like, a sound will be generated even under a condition wherein the panel pieces 21A to 21D have been combined with the base plate 20, and it is possible to increase the interest.

Furthermore, in each of the above-mentioned embodiments, although the sound generating means built in the panel piece is described as to the case in which a disk record sound reproducing device utilizing the disk record 2 and the pickup 13, the present invention is not limited to this described embodiment and an electronic sound generating device may be used.

In the present invention, the following advantages are obtained.

In the first aspect of the invention, since there is unexpectedness in generating a sound from a panel piece of a combination toy, an interest is increased.

In the second and third aspects of the invention, since the disk record sound reproducing device is a thin type, the disk record sound reproducing device can be built in the panel piece without increasing the thickness of the panel piece. Furthermore, since the structure is simple, a large increase in cost is never encountered.

In the fourth aspect of the invention, through the recognition of a relationship between the shape of the panel piece and the kind of sound generated from the panel piece, a large intellectual training effect can be obtained.

What is claimed is:

1. A panel piece combination toy comprising:

(a) at least one panel piece comprising a casing;

(b) a member matched with the panel piece and combinable with the panel piece; and (c) means for generating sound formed in the panel piece, the means for generating sound comprising:

(1) a disk record disposed in the casing, the disk record having an upper surface and a lower surface, the upper surface having a modulated groove formed therein, (2) a driving mechanism disposed in the casing for rotating the disk record, (3) a pickup for scanning the modulated groove in the disk record, and (4) a diaphragm formed by making at least a part of a side of the casing thin, the pickup abutting against the diaphragm.

2. A panel piece combination toy according to claim 1, the at least one panel piece being formed to a shape representative of a specific object; and wherein the means for generating sound generates a sound associated with the specific object.

3. A panel piece combination toy comprising:

(a) at least one panel piece comprising a casing;

(b) a member matched with the panel piece and combinable with the panel piece; and (c) means for generating sound formed in the panel piece, the means for generating sound comprising:

(1) a disk record disposed in the casing, the disk record having an upper surface and a lower surface, the upper surface having a modulated groove formed therein, (2) a driving mechanism disposed within the casing for rotating the disk record, (3) a pickup for scanning the modulated groove in the upper surface of the disk record, and (4) a stylus force mechanism for applying and releasing a stylus force to the pickup, the stylus force mechanism comprising:

(i) an elastic member for urging the disk record towards the casing, the elastic member contacting the lower surface of the disk record, and (ii) an expansion and constriction mechanism disposed between the upper surface and the casing, the expansion and constriction mechanism comprising a disk record side member affixed to the disk record and a casing side member, the casing side member abuts against the casing and is connected to the driving mechanism, the disk record side member and the casing side member having formed on one surface thereof at least one operating claw having an engaging side rising perpendicularly and a slant side having a gradual inclination, the disk record side member and the casing side member being disposed adjacently such that the corresponding engaging sides and the corresponding slant sides of the casing side member and the disk record side member are in abutment.

4. A panel piece combination toy according to claim 3, the at least one panel piece being formed to a shape representative a specific object; and wherein the means for generating sound generates a sound associated with the specific object.

* * * * *